US011047545B1

(12) United States Patent
Chang

(10) Patent No.: US 11,047,545 B1
(45) Date of Patent: Jun. 29, 2021

(54) CONTROLLABLE VEHICLE LAMP ASSEMBLY

(71) Applicant: SONAR AUTO PARTS CO., LTD., New Taipei (TW)

(72) Inventor: Chung-Yi Chang, Hsinchu County (TW)

(73) Assignee: SONAR AUTO PARTS CO., LTD., New Taipei (TW)

( * ) Notice: Subject to any disclaimer, the term of this patent is extended or adjusted under 35 U.S.C. 154(b) by 0 days.

(21) Appl. No.: 17/117,120

(22) Filed: Dec. 10, 2020

(30) Foreign Application Priority Data

Oct. 23, 2020 (TW) ..... 109136835

(51) Int. Cl.

| | |
|---|---|
| ***F21S 41/683*** | (2018.01) |
| ***F21S 41/32*** | (2018.01) |
| ***F21S 45/47*** | (2018.01) |
| ***F21S 41/47*** | (2018.01) |
| ***F21S 41/25*** | (2018.01) |

(52) U.S. Cl.
CPC ..... *F21S 41/683* (2018.01); *F21S 41/25* (2018.01); *F21S 41/32* (2018.01); *F21S 41/47* (2018.01); *F21S 45/47* (2018.01)

(58) Field of Classification Search
None
See application file for complete search history.

(56) References Cited

U.S. PATENT DOCUMENTS

| | | | | |
|---|---|---|---|---|
| 2012/0008335 | A1* | 1/2012 | Yamamoto | F21S 41/36 362/539 |
| 2016/0341391 | A1* | 11/2016 | Yamamoto | B60Q 1/1438 |
| 2016/0363283 | A1* | 12/2016 | Yamamoto | F21S 41/13 |
| 2019/0257494 | A1* | 8/2019 | Mochizuki | F21S 41/43 |

* cited by examiner

*Primary Examiner* — Elmito Breval
(74) *Attorney, Agent, or Firm* — Li & Cai Intellectual Property Office

(57) ABSTRACT

A controllable vehicle lamp assembly includes a carrier module, a light-emitting module, an optical module and a controllable module. The light-emitting module includes a first light-emitting structure and a second light-emitting structure. The first light-emitting structure is disposed on a top side of the carrier module for providing a first light source, and the second light-emitting structure is disposed on a bottom side of the carrier module for providing a second light source. The optical module includes a first reflective cover disposed on the top side of the carrier module, a second reflective cover disposed on the bottom side of the carrier module, a movable shielding assembly movably disposed on the top side of the carrier module, and an optical lens disposed on the top side of the carrier module. The controllable module includes a movable driving component for contacting the movable shielding assembly.

9 Claims, 10 Drawing Sheets

CONTROLLABLE VEHICLE LAMP ASSEMBLY

CROSS-REFERENCE TO RELATED PATENT APPLICATION

This application claims the benefit of priority to Taiwan Patent Application No. 109136835, filed on Oct. 23, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a vehicle lamp assembly, and more particularly to a controllable vehicle lamp assembly.

BACKGROUND OF THE DISCLOSURE

According to different requirements, a driver can control a conventional vehicle lamp to project high beam light or low beam light (such as one functioning as a high/low beam headlamp), but the conventional vehicle lamp still has room for improvement.

SUMMARY OF THE DISCLOSURE

In response to the above-referenced technical inadequacy, the present disclosure provides a controllable vehicle lamp assembly.

In one aspect, the present disclosure provides a controllable vehicle lamp assembly including a carrier module, a light-emitting module, an optical module and a controllable module. The light-emitting module includes a first light-emitting structure electrically connected to the carrier module and a second light-emitting structure electrically connected to the carrier module. The first light-emitting structure is disposed on a top side of the carrier module for providing a first light source, and the second light-emitting structure is disposed on a bottom side of the carrier module for providing a second light source. The optical module includes a first reflective cover disposed on the top side of the carrier module, a second reflective cover disposed on the bottom side of the carrier module, a movable shielding assembly movably disposed on the top side of the carrier module, and an optical lens disposed on the top side of the carrier module. The controllable module includes a movable driving component for contacting the movable shielding assembly. A plurality of first light beams generated by the first light source are reflected by the first reflective cover so as to form a plurality of first reflected light beams, a plurality of second light beams generated by the first light source are reflected by the first reflective cover so as to form a plurality of second reflected light beams, a plurality of third light beams generated by the first light source are reflected by the first reflective cover so as to form a plurality of third reflected light beams, and a plurality of light beams generated by the second light source are reflected by the second reflective cover so as to form a plurality of reflected light beams. When the movable shielding assembly is moved from a first position to a second position by controlling of the movable driving component, the first reflected light beams pass through the optical lens so as to be converted into a plurality of first projected light beams, the second reflected light beams pass through the optical lens so as to be converted into a plurality of second projected light beams, and the third reflected light beams are blocked by the movable shielding assembly and do not directly pass through the optical lens. When the movable shielding assembly is moved from the second position to the first position, the first reflected light beams pass through the optical lens so as to be converted into the first projected light beams, the second reflected light beams are blocked by the movable shielding assembly and do not directly pass through the optical lens, and the third reflected light beams are reflected by the movable shielding assembly and pass through the optical lens so as to be converted into a plurality of third projected light beams.

In another aspect, the present disclosure provides a controllable vehicle lamp assembly including a carrier module, a light-emitting module, an optical module and a controllable module. The light-emitting module includes a first light-emitting structure disposed on a top side of the carrier module for providing a first light source. The optical module includes a first reflective cover disposed on the top side of the carrier module, a movable shielding assembly movably disposed on the top side of the carrier module, and an optical lens disposed on the top side of the carrier module. The controllable module includes a movable driving component for contacting the movable shielding assembly. A plurality of first light beams generated by the first light source are reflected by the first reflective cover so as to form a plurality of first reflected light beams, a plurality of second light beams generated by the first light source are reflected by the first reflective cover so as to form a plurality of second reflected light beams, and a plurality of third light beams generated by the first light source are reflected by the first reflective cover so as to form a plurality of third reflected light beams. The first reflected light beams pass through the optical lens so as to be converted into a plurality of first projected light beams, the second reflected light beams pass through the optical lens so as to be converted into a plurality of second projected light beams or the second reflected light beams are blocked by the movable shielding assembly and do not directly pass through the optical lens, and the third reflected light beams are blocked by the movable shielding assembly and do not directly pass through the optical lens or the third reflected light beams are reflected by the movable shielding assembly and pass through the optical lens so as to be converted into a plurality of third projected light beams.

In yet another aspect, the present disclosure provides a controllable vehicle lamp assembly including a carrier module, a light-emitting module, an optical module and a controllable module. The light-emitting module includes a first light-emitting structure that is electrically connected to the carrier module for providing a first light source. The optical module is disposed on the carrier module, and the optical module includes a first reflective cover, a movable shielding assembly and an optical lens. The controllable module includes a movable driving component for contacting the movable shielding assembly.

Therefore, by virtue of "the optical module including a first reflective cover, a movable shielding assembly and an optical lens" and "the controllable module including a movable driving component for contacting the movable shielding assembly", the movable shielding assembly can be moved from the first position to the second position by controlling of the movable driving component. Therefore, the second reflected light beams can pass through the optical lens so as to be converted into a plurality of second projected light beams or the second reflected light beams can be blocked by the movable shielding assembly and do not directly pass through the optical lens by selectively moving the movable shielding assembly between the first position and the second position, and the third reflected light beams can be blocked by the movable shielding assembly and do not directly pass through the optical lens or the third reflected light beams can be reflected by the movable shielding assembly and pass through the optical lens so as to be converted into a plurality of third projected light beams by selectively moving the movable shielding assembly between the first position and the second position.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
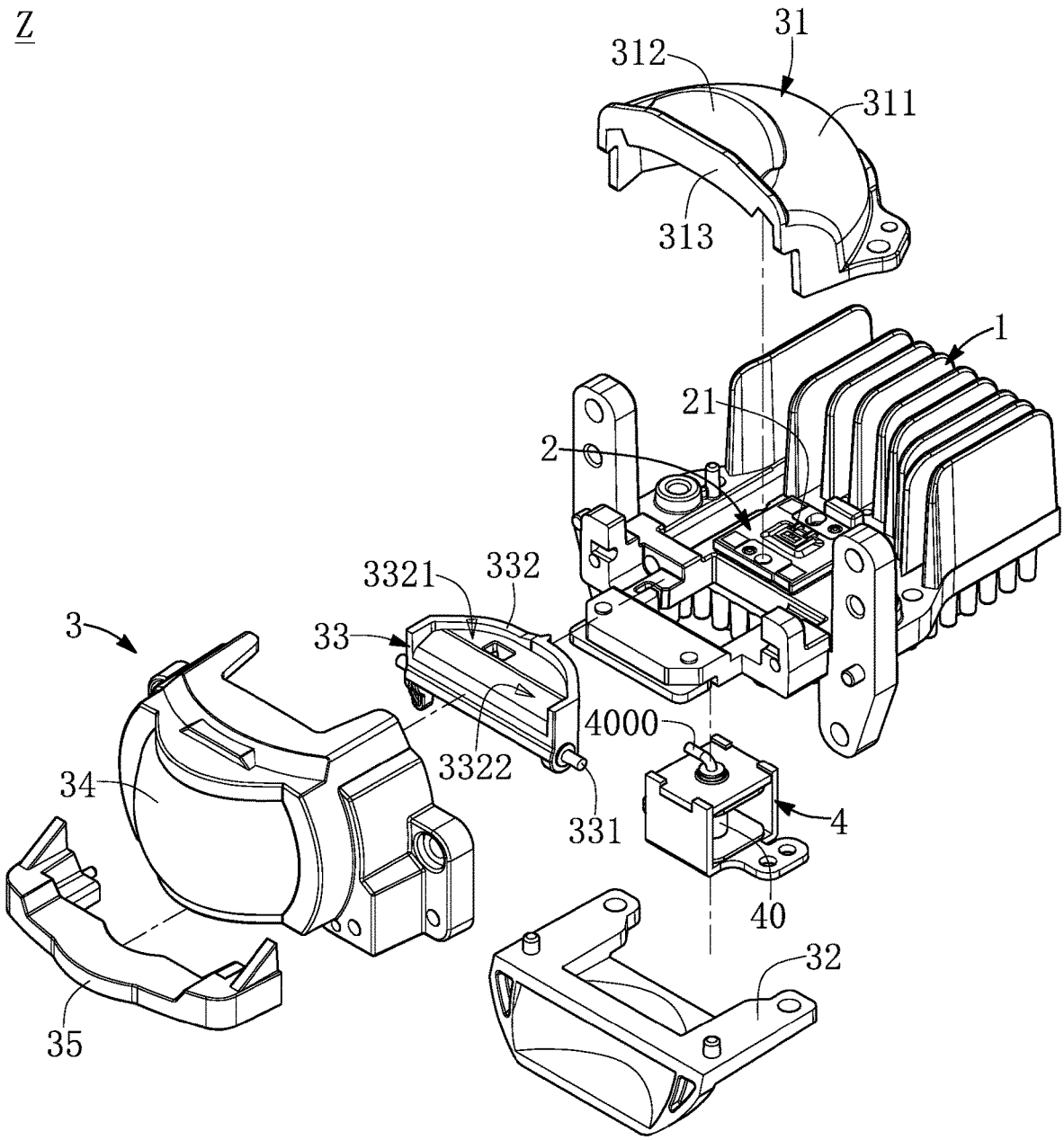
FIG. 1 is a perspective exploded schematic view of a controllable vehicle lamp assembly according to the present disclosure.
Figure 2:
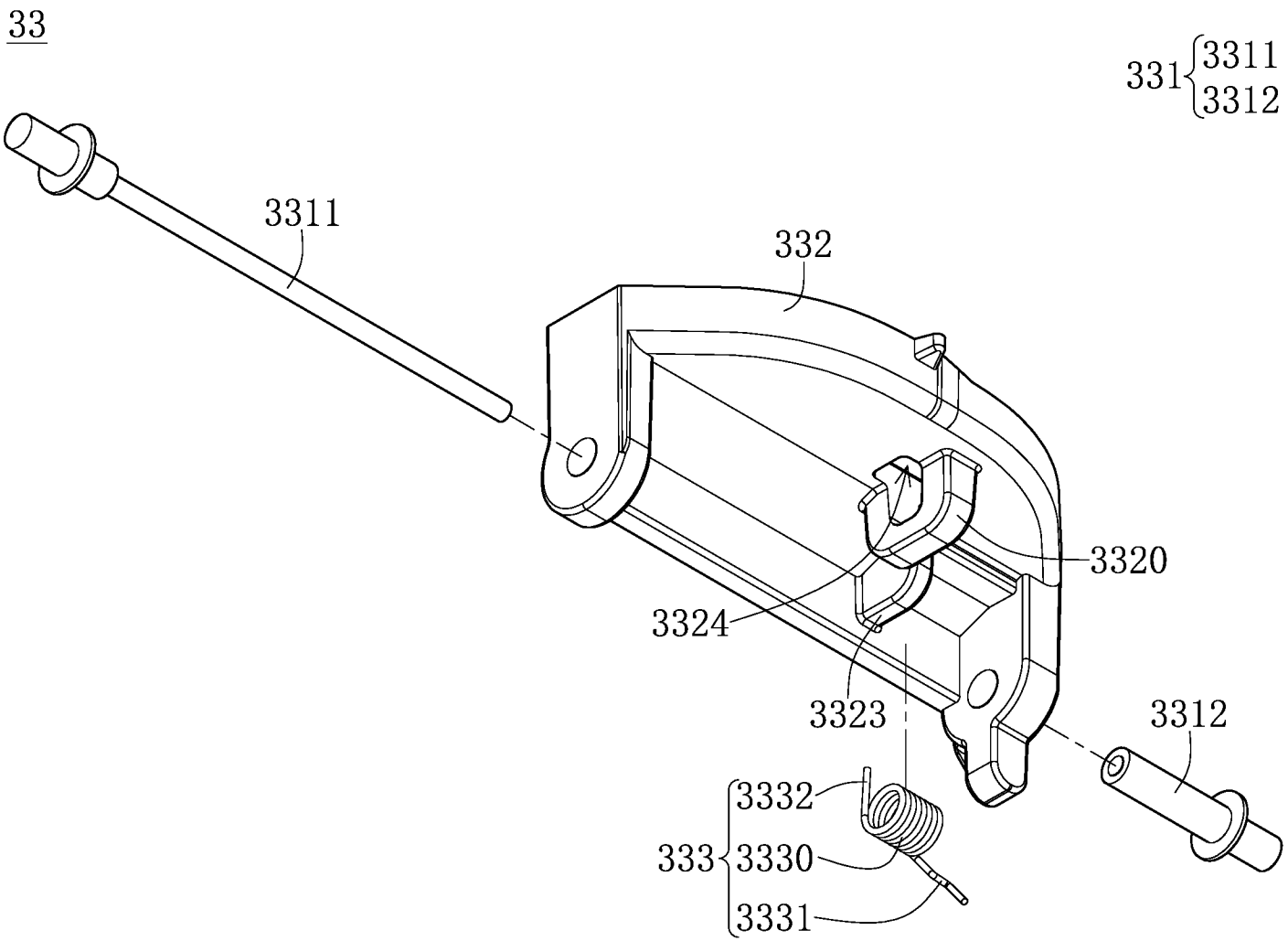
FIG. 2 is a perspective exploded schematic view of a movable shielding assembly of the controllable vehicle lamp assembly according to the present disclosure.
Figure 3:
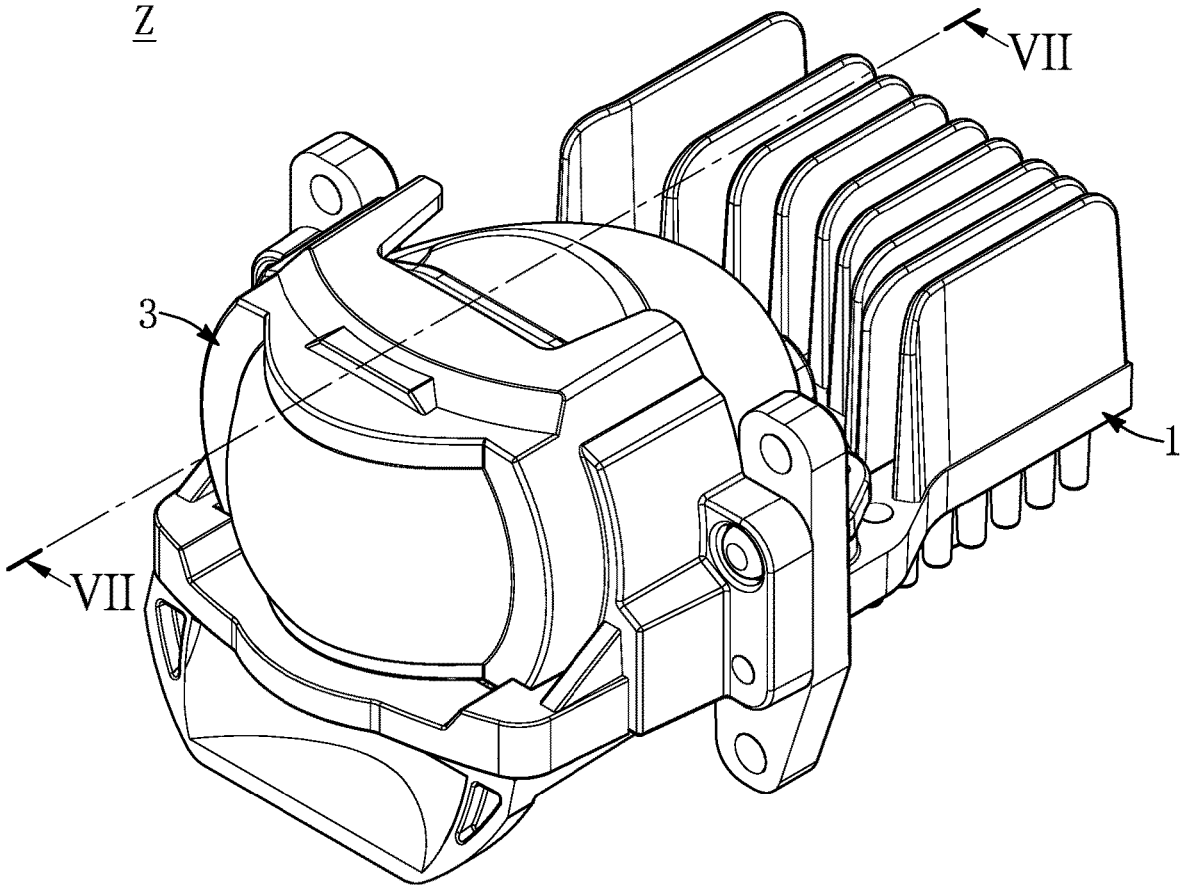
FIG. 3 is a perspective assembled schematic view of the controllable vehicle lamp assembly according to the present disclosure.
Figure 4:
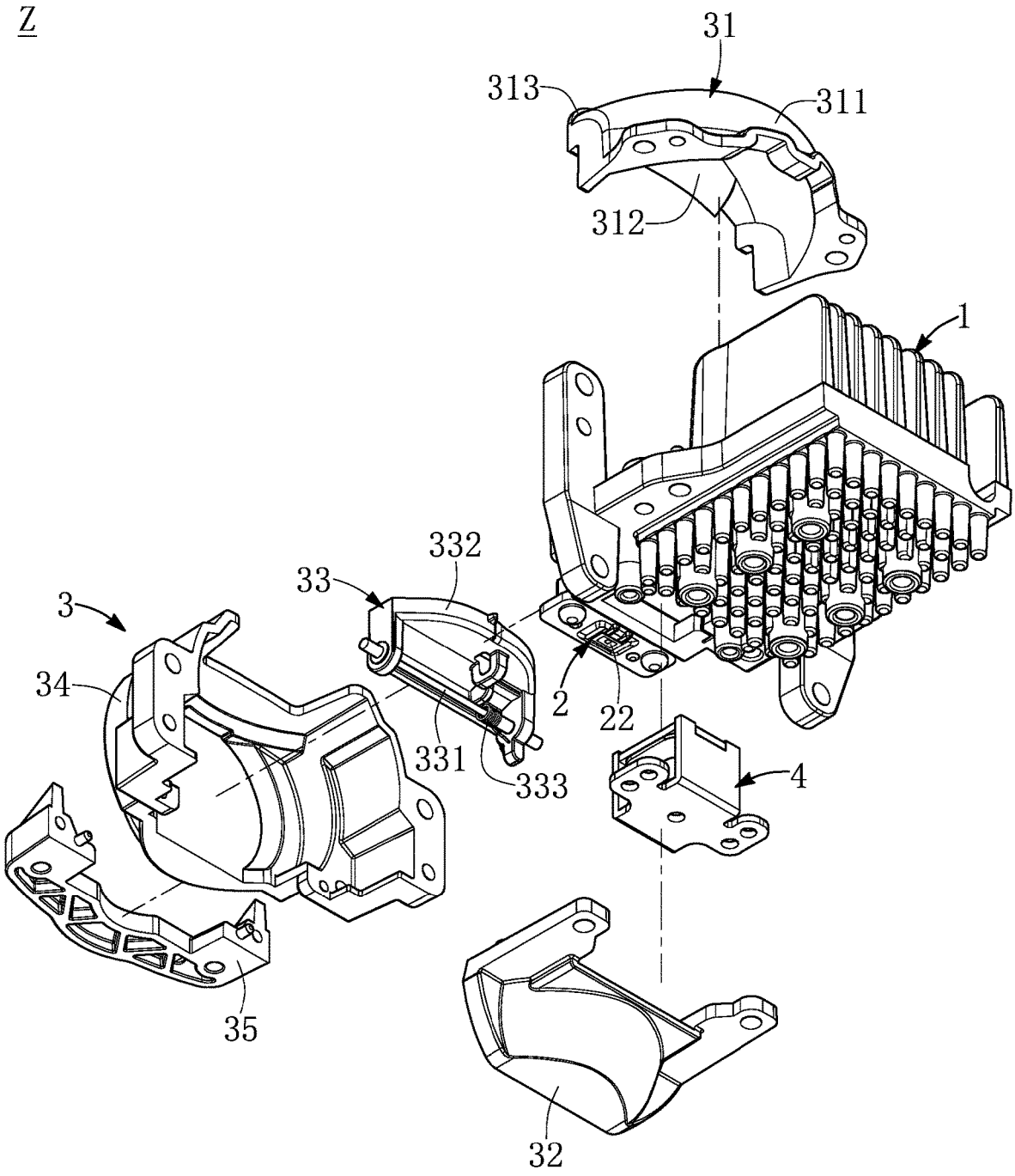
FIG. 4 is another perspective exploded schematic view of a controllable vehicle lamp assembly according to the present disclosure.
Figure 5:
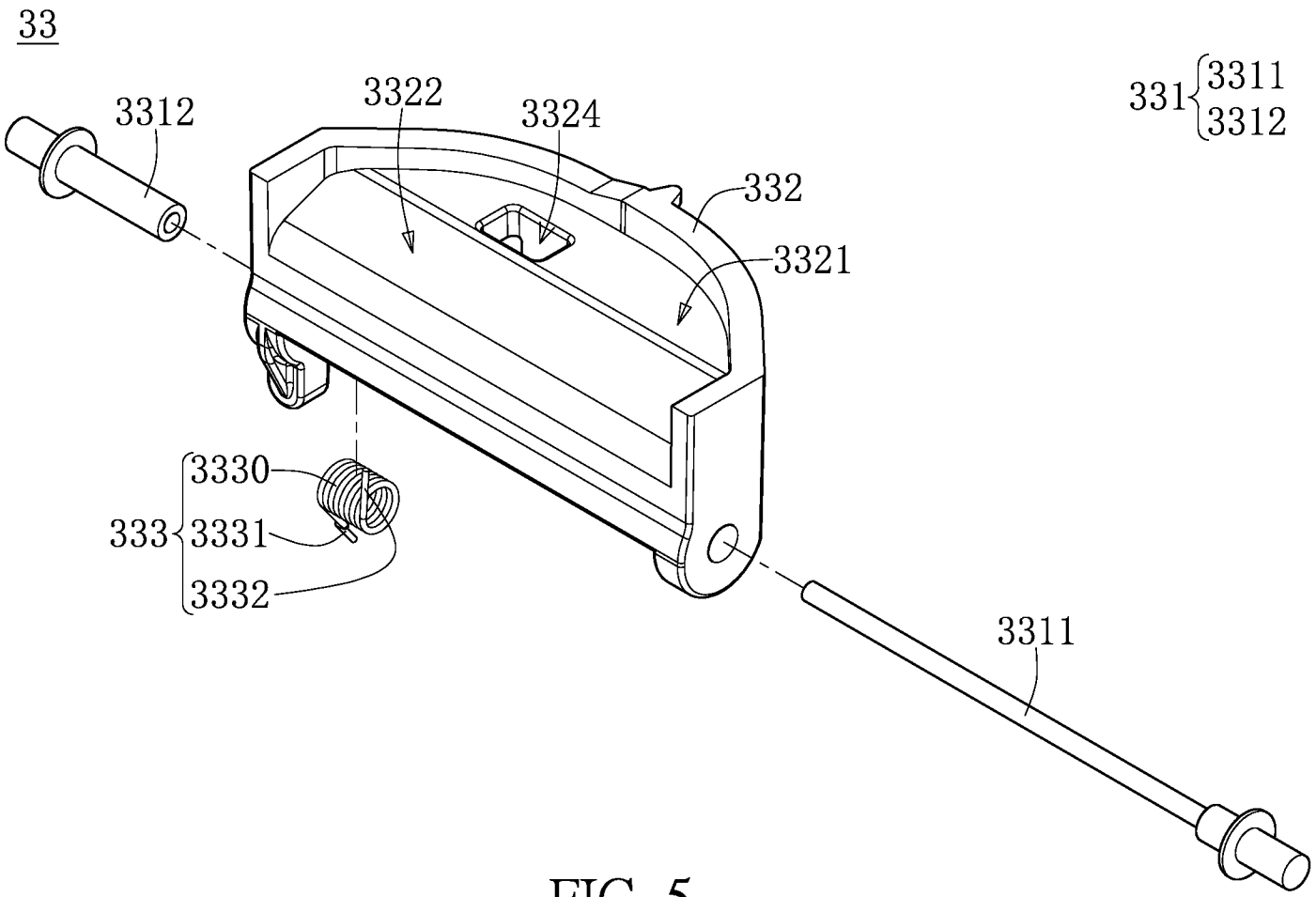
FIG. 5 is another perspective exploded schematic view of a movable shielding assembly of the controllable vehicle lamp assembly according to the present disclosure.
Figure 6:
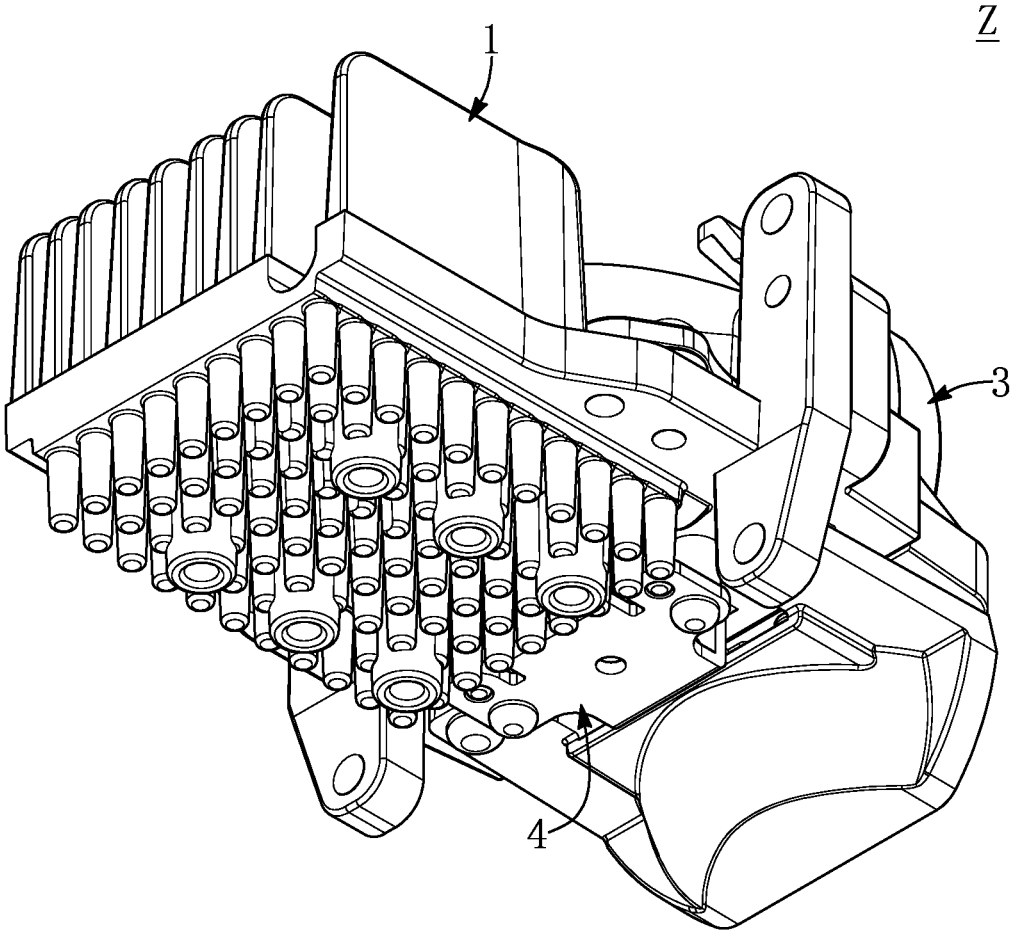
FIG. 6 is another perspective assembled schematic view of the controllable vehicle lamp assembly according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 10, the present disclosure provides a controllable vehicle lamp assembly Z including a carrier module 1, a light-emitting module 2, an optical module 3 and a controllable module 4. The light-emitting module 2 includes a first light-emitting structure 21, and the first light-emitting structure 21 is electrically connected to the carrier module 1 for providing a first light source S1. The optical module 3 is disposed on the carrier module 1, and the optical module 3 includes a first reflective cover 31, a movable shielding assembly 33 and an optical lens 34. The controllable module 4 includes a movable driving component 40 for contacting the movable shielding assembly 33, and the movable shielding assembly 33 can be moved from a first position to a second position by controlling of the movable driving component 40. Therefore, a plurality of second reflected light beams R2 can selectively "pass through the optical lens 34 so as to be converted into a plurality of second projected light beams P2" or "be blocked by the movable shielding assembly 33 and not directly pass through the optical lens 34 by selectively moving the movable shielding assembly 33 between the first position and the second position, and the third reflected light beams R3 can selectively "be blocked by the movable shielding assembly 33 and not directly pass through the optical lens 34" or "be reflected by the movable shielding assembly 33 and pass through the optical lens 34 so as to be converted into a plurality of third projected light beams P3 by selectively moving the movable shielding assembly 33 between the first position and the second position.

Embodiment

Referring to FIG. 1 to FIG. 10, one embodiment of the present disclosure provides a controllable vehicle lamp assembly Z including a carrier module 1, a light-emitting module 2, an optical module 3 and a controllable module 4.

More particularly, referring to FIG. 1, FIG. 4, FIG. 9, and FIG. 10, the light-emitting module 2 includes a first light-emitting structure 21 electrically connected to the carrier module 1 and a second light-emitting structure 22 electrically connected to the carrier module 1. The first light-emitting structure 21 is disposed on a top side of the carrier module 1 for providing a first light source S1, and the second light-emitting structure 22 is disposed on a bottom side of the carrier module 1 for providing a second light source S2. For example, the first light-emitting structure 21 includes at least one or a plurality of LED light sources or any other kind of light-emitting source, and the second light-emitting structure 22 includes at least one or a plurality of LED light sources or any other kind of light-emitting source. However, the aforementioned description is merely an example and is not meant to limit the scope of the present disclosure.

Moreover, referring to FIG. 1, FIG. 4, FIG. 7, and FIG. 8, the optical module 3 includes a first reflective cover 31 disposed on the top side of the carrier module 1, a second reflective cover 32 disposed on the bottom side of the carrier module 1, a movable shielding assembly 33 movably disposed on the top side of the carrier module 1, and an optical lens 34 disposed on the top side of the carrier module 1, and the controllable module 4 includes a movable driving component 40 for contacting the movable shielding assembly 33. For example, the controllable module 4 may be an electromagnetic control module (such as an electronic control module) or a mechanical control module, but the aforementioned description is merely an example and is not meant to limit the scope of the present disclosure.

Figure 8:
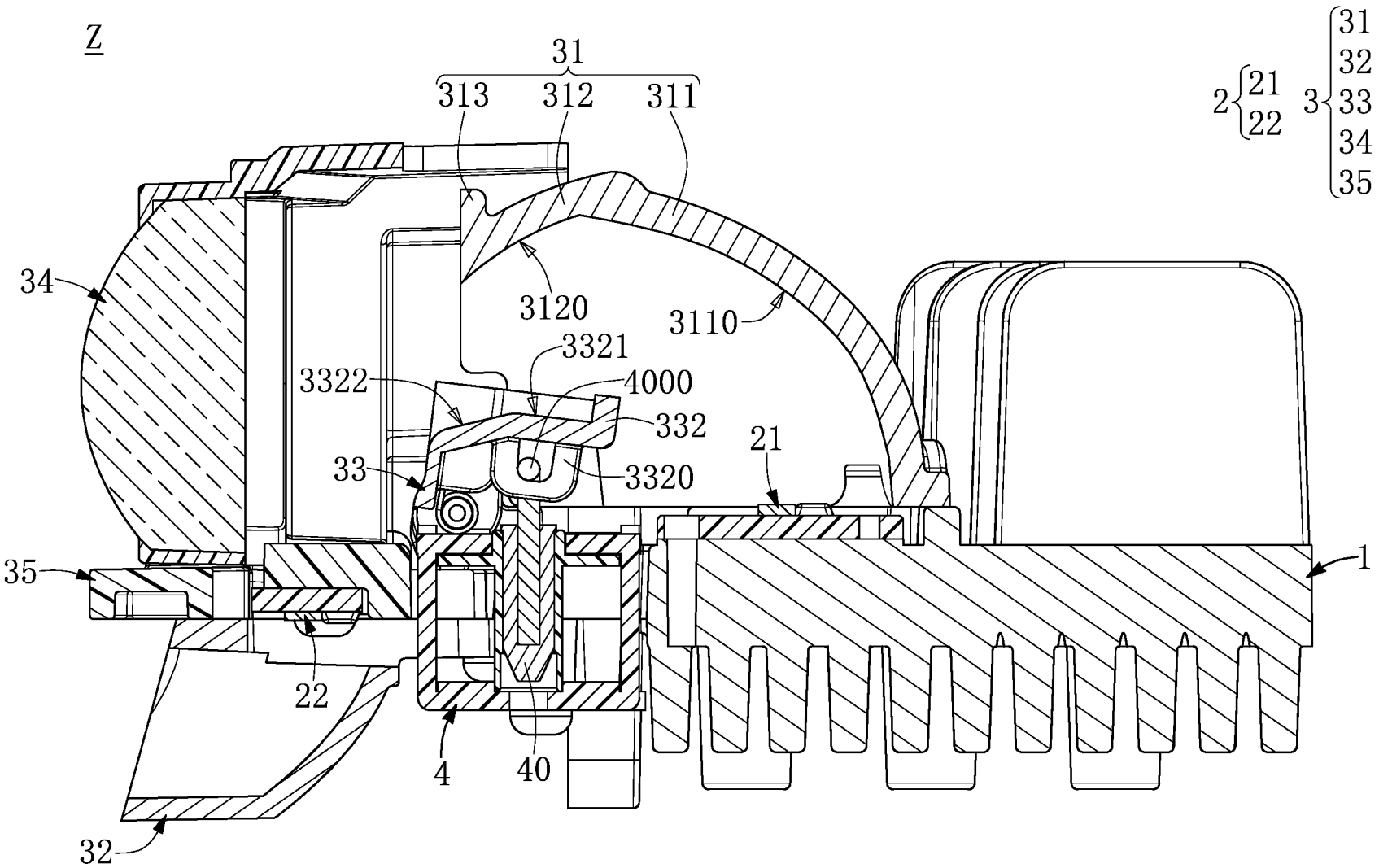
FIG. 8 is a cross-sectional schematic view of the movable shielding assembly being moved from a first position to a second position by controlling a movable driving component according to the present disclosure.
Figure 9:
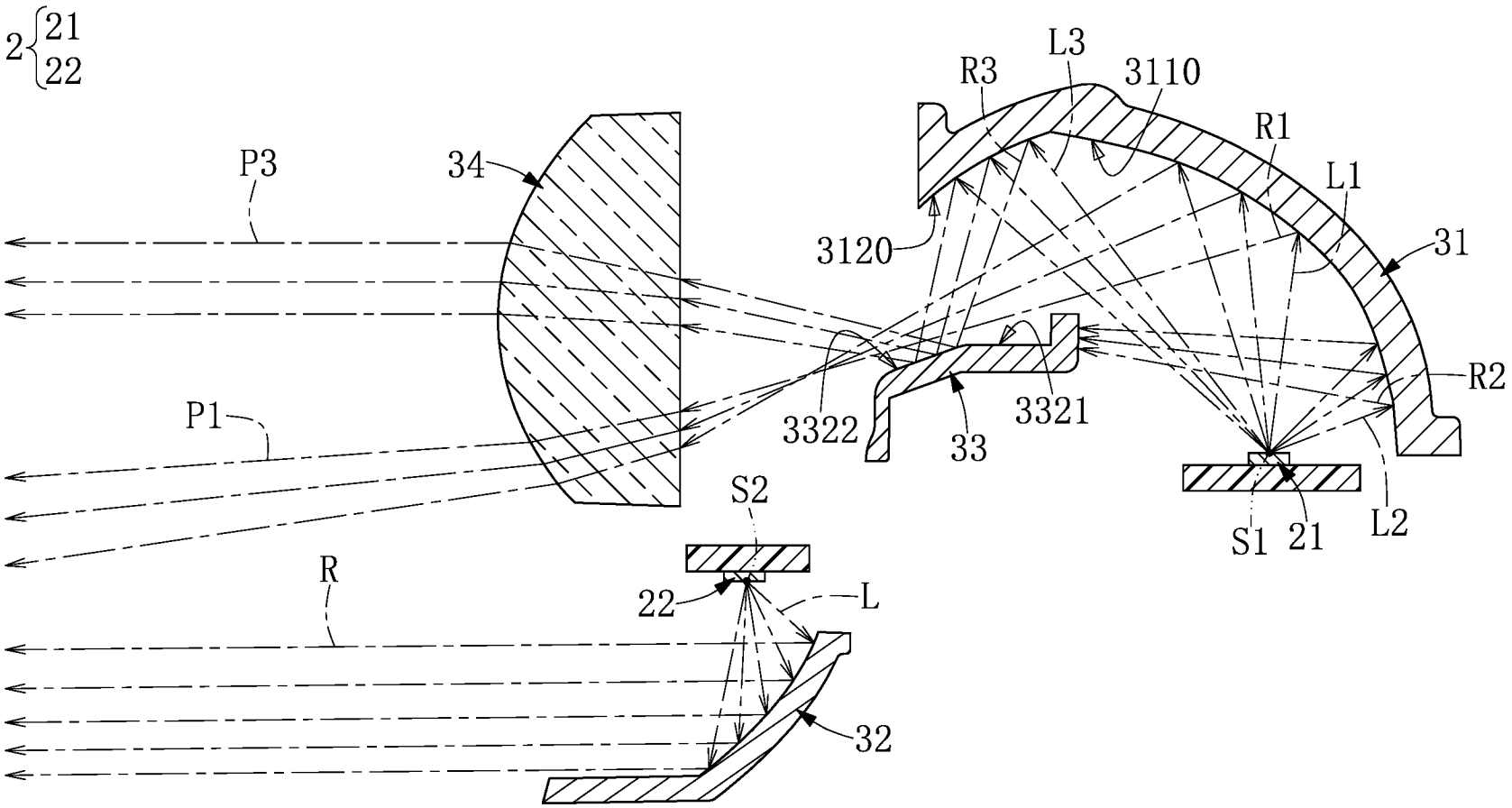
FIG. 9 is a schematic view of an optical path provided by the controllable vehicle lamp assembly as shown in FIG. 7 according to the present disclosure.
Figure 10:
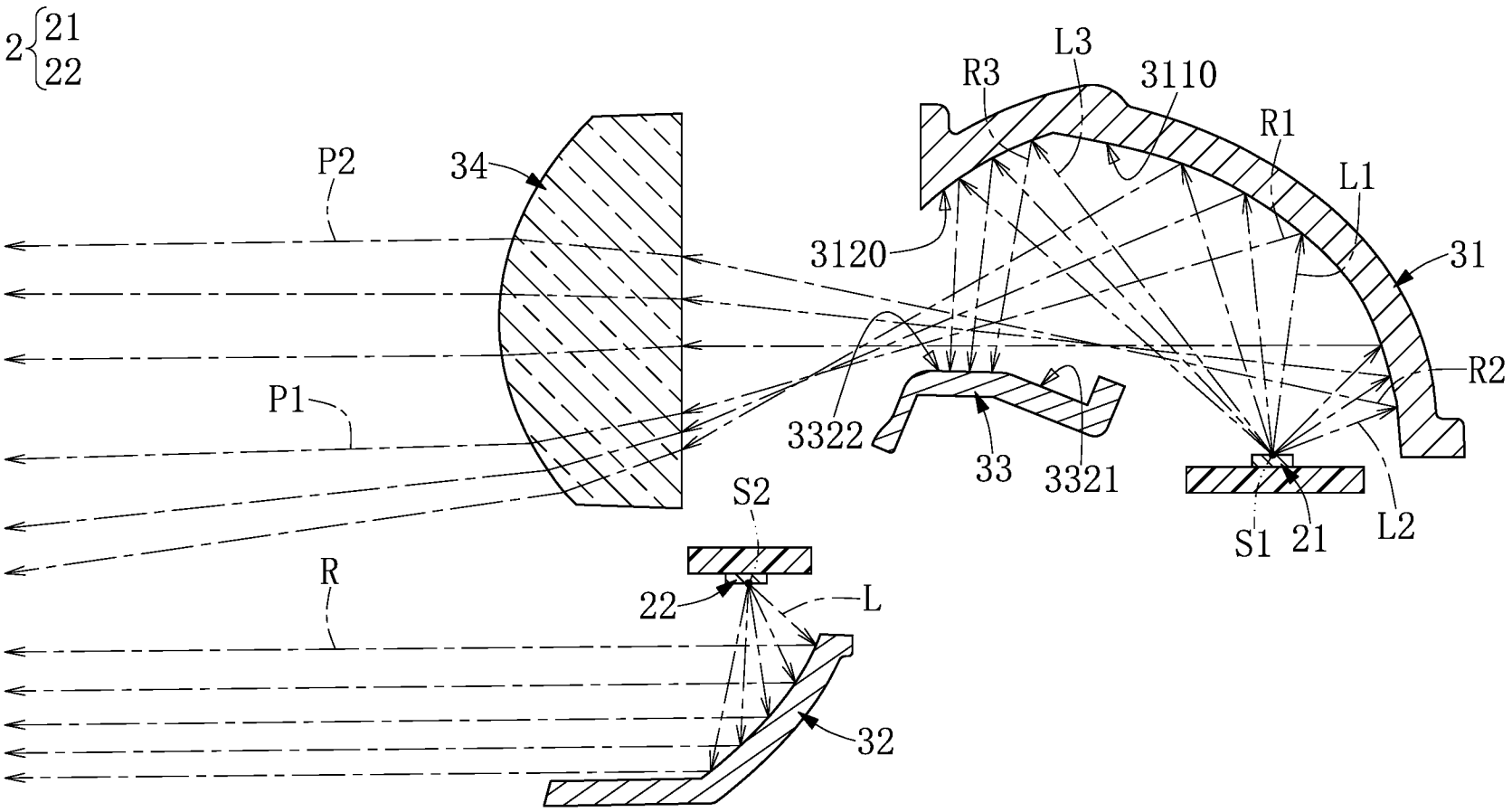
FIG. 10 is a schematic view of an optical path provided by the controllable vehicle lamp assembly as shown in FIG. 8 according to the present disclosure.

Therefore, referring to FIG. 9 and FIG. 10, a plurality of first light beams L1 generated by the first light source S1 can be reflected by the first reflective cover 31 so as to form a plurality of first reflected light beams R1, a plurality of second light beams L2 generated by the first light source S1 can be reflected by the first reflective cover 31 so as to form a plurality of second reflected light beams R2, a plurality of third light beams L3 generated by the first light source S1 can be reflected by the first reflective cover 31 so as to form a plurality of third reflected light beams R3, and a plurality of light beams L generated by the second light source S2 can be reflected by the second reflective cover 32 so as to form a plurality of reflected light beams R. Furthermore, referring to FIG. 8 and FIG. 10, when the movable shielding assembly 33 is moved from a first position to a second position by controlling of the movable driving component 40 (such as moving the movable driving component 40 downwardly), the first reflected light beams R1 can pass through the optical lens 34 so as to be converted into a plurality of first projected light beams P1, the second reflected light beams R2 can pass through the optical lens 34 so as to be converted into a plurality of second projected light beams P2, and the third reflected light beams R3 are blocked by the movable shielding assembly 33 and do not directly pass through the optical lens 34. For example, the controllable vehicle lamp assembly Z can be used as a "high beam light" by cooperation of the first projected light beams P1 and the second projected light beams P2. In addition, referring to FIG. 7 and FIG. 9, when the movable shielding assembly 33 is moved from the second position to the first position, the first reflected light beams R1 can pass through the optical lens 34 so as to be converted into the first projected light beams P1, the second reflected light beams R2 can be blocked by the movable shielding assembly 33 and do not directly pass through the optical lens 34, and the third reflected light beams R3 can be reflected by the movable shielding assembly 33 and pass through the optical lens 34 so as to be converted into a plurality of third projected light beams P3 (that is to say, the third reflected light beams R3 can be reflected by the movable shielding assembly 33 in advance, and can then pass through the optical lens 34 so as to be converted into the third projected light beams P3). For example, the controllable vehicle lamp assembly Z can be used as a "low beam light" by cooperation of the first projected light beams P1 and the third projected light beams P3.

Figure 7:
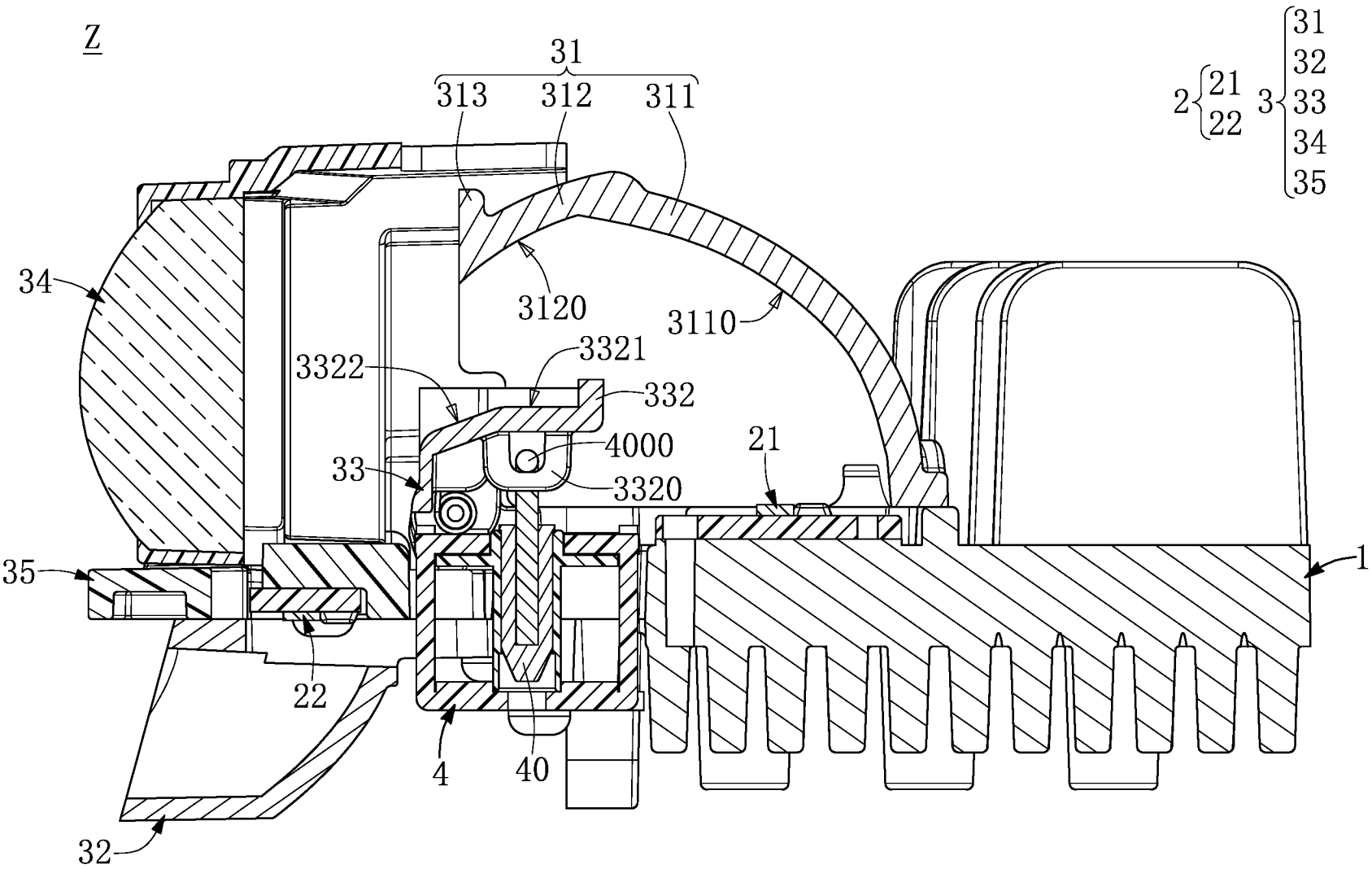
FIG. 7 is a cross-sectional view taken along line VII-VII of FIG. 3.

For example, referring to FIG. 1, FIG. 2, FIG. 4, and FIG. 5, the movable shielding assembly 33 includes a pivot element 331 disposed on the carrier module 1, a movable shielding element 332 pivotably disposed on the pivot element 331, and an elastic element 333 disposed around (such as sleeved around) the pivot element 331, and the pivot element 331 includes a first pivot portion 3311 and a second pivot portion 3312 that matches (or cooperates) with the first pivot portion 3311. Furthermore, the elastic element 333 has an elastic body 3330 disposed around (such as sleeved around) the pivot element 331, a first abutting portion 3331 connected to a side of the elastic body 3330 for abutting against the carrier module 1, and a second abutting portion 3332 connected to another side of the elastic body 3330 for abutting against the movable shielding element 332, and the movable shielding element 332 can be moved from the second position to the first position by an elastic force provided by the elastic element 333 (that is to say, the movable shielding element 332 can be accurately fixed on the first position by the elastic force provided by the elastic element 333 as shown in FIG. 7). Moreover, the movable shielding element 332 has a fixed matching portion 3320, a stop portion 3323 for blocking the second abutting portion 3332 of the elastic element 333, and a penetrating portion 3324 corresponding to the fixed matching portion 3320, and the movable driving component 40 includes a movable matching portion 4000 that matches with the fixed matching portion 3320. Therefore, the movable shielding element 332 can be downwardly pulled by the movable driving component 40 that is controlled by cooperation of the fixed matching portion 3320 and the movable matching portion 4000, so that the movable shielding element 332 can be moved from the first position to the second position (as shown in FIG. 8). It should be noted that the optical module 3 includes a light-reflecting component 35 disposed under the optical lens 34, the light-reflecting component 35 is disposed between the optical lens 34 and the second reflective cover 32, and the optical lens 34 protrudes further from the optical module 3 than the light-reflecting component 35.

For example, referring to FIG. 1, FIG. 4, FIG. 7 and FIG. 8, the movable shielding element 332 has a first reflective surface 3321 and a second reflective surface 3322 obliquely connected to the first reflective surface 3321, and the first reflective cover 31 includes a first reflective body 311, a second reflective body 312 connected to the first reflective body 311, and a shielding portion 313 extending upwardly from the second reflective body 312. Furthermore, the first reflective body 311 has a first reflective curved surface 3110, the second reflective body 312 has a second reflective curved surface 3120 connected to the first reflective curved surface 3110, and the first reflective curved surface 3110 has a curvature (or a radius of curvature) different from that of the second reflective curved surface 3120. Moreover, referring to FIG. 9 and FIG. 10, the first light beams L1 of the first light source S1 can be reflected by the first reflective curved surface 3110 of the first reflective cover 31 so as to form the first reflected light beams R1, the second light beams L2 of the first light source S1 can be reflected by the first reflective curved surface 3110 of the first reflective cover 31 so as to form the second reflected light beams R2, and the third light beams L3 of the first light source S1 can be reflected by the second reflective curved surface 3120 of the first reflective cover 31 so as to form the third reflected light beams R3. Therefore, referring to FIG. 8 and FIG. 10, when the movable shielding assembly 33 is moved from the first position to the second position by controlling of the movable driving component 40, the third reflected light beams R3 can be projected onto the second reflective surface 3322 of the movable shielding assembly 33 and do not directly pass through the optical lens 34. In addition, referring to FIG. 7 and FIG. 9, when the movable shielding assembly 33 is moved from the second position to the first position by the elastic force provided by the elastic element 333, the third reflected light beams R3 can be projected onto the second reflective surface 3322 of the movable shielding assembly 33 and pass through the optical lens 34 so as to be converted into the third projected light beams P3 (that is so say, the third reflected light beams R3 can be projected onto the second reflective surface 3322 of the movable shielding assembly 33 in advance, and can then pass through the optical lens 34 so as to be converted into the third projected light beams P3).

Beneficial Effects of Embodiment

In conclusion, by virtue of "the optical module 3 including a first reflective cover 31, a movable shielding assembly 33 and an optical lens 34" and "the controllable module 4 including a movable driving component 40 for contacting the movable shielding assembly 33", the movable shielding assembly 33 can be moved from the first position to the second position by controlling of the movable driving component 40. Therefore, the second reflected light beams R2 can pass through the optical lens 34 so as to be converted into a plurality of second projected light beams P2 or the second reflected light beams R2 can be blocked by the movable shielding assembly 33 and do not directly pass through the optical lens 34 by selectively moving the movable shielding assembly 33 between the first position and the second position, and the third reflected light beams R3 can be blocked by the movable shielding assembly 33 and do not directly pass through the optical lens 34 or the third reflected light beams R3 can be reflected by the movable shielding assembly 33 and pass through the optical lens 34 so as to be converted into a plurality of third projected light beams P3 by selectively moving the movable shielding assembly 33 between the first position and the second position.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A controllable vehicle lamp assembly, comprising:

a carrier module;

a light-emitting module including a first light-emitting structure electrically connected to the carrier module, and a second light-emitting structure electrically connected to the carrier module, wherein the first light-emitting structure is disposed on a top side of the carrier module for providing a first light source, and the second light-emitting structure is disposed on a bottom side of the carrier module for providing a second light source;

an optical module including a first reflective cover disposed on the top side of the carrier module, a second reflective cover disposed on the bottom side of the carrier module, a movable shielding assembly movably disposed on the top side of the carrier module, and an optical lens disposed on the top side of the carrier module; and a controllable module including a movable driving component for contacting the movable shielding assembly;

wherein a plurality of first light beams generated by the first light source are reflected by the first reflective cover so as to form a plurality of first reflected light beams, a plurality of second light beams generated by the first light source are reflected by the first reflective cover so as to form a plurality of second reflected light beams, a plurality of third light beams generated by the first light source are reflected by the first reflective cover so as to form a plurality of third reflected light beams, and a plurality of light beams generated by the second light source are reflected by the second reflective cover so as to form a plurality of reflected light beams;

wherein, when the movable shielding assembly is moved from a first position to a second position by controlling of the movable driving component, the first reflected light beams pass through the optical lens so as to be converted into a plurality of first projected light beams, the second reflected light beams pass through the optical lens so as to be converted into a plurality of second projected light beams, and the third reflected light beams are blocked by the movable shielding assembly and do not directly pass through the optical lens;

wherein, when the movable shielding assembly is moved from the second position to the first position, the first reflected light beams pass through the optical lens so as to be converted into the first projected light beams, the second reflected light beams are blocked by the movable shielding assembly and do not directly pass through the optical lens, and the third reflected light beams are reflected by the movable shielding assembly and pass through the optical lens so as to be converted into a plurality of third projected light beams.

2. The controllable vehicle lamp assembly according to claim 1, wherein the movable shielding assembly includes a pivot element disposed on the carrier module, a movable shielding element pivotably disposed on the pivot element, and an elastic element disposed around the pivot element, and the pivot element includes a first pivot portion and a second pivot portion that matches with the first pivot portion; wherein the elastic element has an elastic body disposed around the pivot element, a first abutting portion connected to a side of the elastic body for abutting against the carrier module, and a second abutting portion connected to another side of the elastic body for abutting against the movable shielding element, and the movable shielding element is moved from the second position to the first position by an elastic force provided by the elastic element; wherein the movable shielding element has a fixed matching portion, a stop portion for blocking the second abutting portion of the elastic element, and a penetrating portion corresponding to the fixed matching portion, the movable driving component includes a movable matching portion that matches with the fixed matching portion, and the movable shielding element is pulled downwardly by the movable driving component through cooperation of the fixed matching portion and the movable matching portion, so that the movable shielding element is moved from the first position to the second position; wherein the optical module includes a light-reflecting component disposed under the optical lens, the light-reflecting component is disposed between the optical lens and the second reflective cover, and the optical lens protrudes further from the optical module than the light-reflecting component.

3. The controllable vehicle lamp assembly according to claim 2, wherein the movable shielding element has a first reflective surface and a second reflective surface obliquely connected to the first reflective surface, and the first reflective cover includes a first reflective body, a second reflective body connected to the first reflective body, and a shielding portion extending upwardly from the second reflective body; wherein the first reflective body has a first reflective curved surface, the second reflective body has a second reflective curved surface connected to the first reflective curved surface, and the first reflective curved surface has a curvature different from that of the second reflective curved surface; wherein the first light beams of the first light source are reflected by the first reflective curved surface of the first reflective cover so as to form the first reflected light beams, the second light beams of the first light source are reflected by the first reflective curved surface of the first reflective cover so as to form the second reflected light beams, and the third light beams of the first light source are reflected by the second reflective curved surface of the first reflective cover so as to form the third reflected light beams; wherein, when the movable shielding assembly is moved from the first position to the second position, the third reflected light beams are projected onto the second reflective surface of the movable shielding assembly and do not directly pass through the optical lens; wherein, when the movable shielding assembly is moved from the second position to the first position, the third reflected light beams are projected onto the second reflective surface of the movable shielding assembly and pass through the optical lens so as to be converted into the third projected light beams.

4. A controllable vehicle lamp assembly, comprising:

a carrier module;

a light-emitting module including a first light-emitting structure disposed on a top side of the carrier module for providing a first light source;

an optical module including a first reflective cover disposed on the top side of the carrier module, a movable shielding assembly movably disposed on the top side of the carrier module, and an optical lens disposed on the top side of the carrier module; and a controllable module including a movable driving component for contacting the movable shielding assembly;

wherein a plurality of first light beams generated by the first light source are reflected by the first reflective cover so as to form a plurality of first reflected light beams, a plurality of second light beams generated by the first light source are reflected by the first reflective cover so as to form a plurality of second reflected light beams, and a plurality of third light beams generated by the first light source are reflected by the first reflective cover so as to form a plurality of third reflected light beams;

wherein the first reflected light beams pass through the optical lens so as to be converted into a plurality of first projected light beams, the second reflected light beams pass through the optical lens so as to be converted into a plurality of second projected light beams or the second reflected light beams are blocked by the movable shielding assembly and do not directly pass through the optical lens, and the third reflected light beams are blocked by the movable shielding assembly and do not directly pass through the optical lens or the third reflected light beams are reflected by the movable shielding assembly and pass through the optical lens so as to be converted into a plurality of third projected light beams.

5. The controllable vehicle lamp assembly according to claim 4, wherein the movable shielding assembly includes a pivot element disposed on the carrier module, a movable shielding element pivotably disposed on the pivot element, and an elastic element disposed around the pivot element, and the pivot element includes a first pivot portion and a second pivot portion that matches with the first pivot portion; wherein the elastic element has an elastic body disposed around the pivot element, a first abutting portion connected to a side of the elastic body for abutting against the carrier module, and a second abutting portion connected to another side of the elastic body for abutting against the movable shielding element, and the movable shielding element is moved from the second position to the first position by an elastic force provided by the elastic element; wherein the movable shielding element has a fixed matching portion, a stop portion for blocking the second abutting portion of the elastic element, and a penetrating portion corresponding to the fixed matching portion, the movable driving component includes a movable matching portion that matches with the fixed matching portion, and the movable shielding element is downwardly pulled by the movable driving component that is controlled by cooperation of the fixed matching portion and the movable matching portion, so that the movable shielding element is moved from the first position to the second position; wherein the optical module includes a light-reflecting component disposed under the optical lens, the light-reflecting component is disposed between the optical lens and a second reflective cover, and the optical lens protrudes further from the optical module than the light-reflecting component.

6. The controllable vehicle lamp assembly according to claim 5, wherein the movable shielding element has a first reflective surface and a second reflective surface obliquely connected to the first reflective surface, and the first reflective cover includes a first reflective body, a second reflective body connected to the first reflective body, and a shielding portion extending upwardly from the second reflective body; wherein the first reflective body has a first reflective curved surface, the second reflective body has a second reflective curved surface connected to the first reflective curved surface, and the first reflective curved surface has a curvature different from that of the second reflective curved surface; wherein the first light beams of the first light source are reflected by the first reflective curved surface of the first reflective cover so as to form the first reflected light beams, the second light beams of the first light source are reflected by the first reflective curved surface of the first reflective cover so as to form the second reflected light beams, and the third light beams of the first light source are reflected by the second reflective curved surface of the first reflective cover so as to form the third reflected light beams; wherein, when the movable shielding assembly is moved from the first position to the second position, the third reflected light beams are projected onto the second reflective surface of the movable shielding assembly and do not directly pass through the optical lens; wherein, when the movable shielding assembly is moved from the second position to the first position, the third reflected light beams are projected onto the second reflective surface of the movable shielding assembly and pass through the optical lens so as to be converted into the third projected light beams.

7. A controllable vehicle lamp assembly, comprising:

a carrier module;

a light-emitting module including a first light-emitting structure electrically connected to the carrier module for providing a first light source;

an optical module disposed on the carrier module, wherein the optical module includes a first reflective cover, a movable shielding assembly and an optical lens; and a controllable module including a movable driving component for contacting the movable shielding assembly;

wherein a plurality of first light beams generated by the first light source are reflected by the first reflective cover so as to form a plurality of first reflected light beams, a plurality of second light beams generated by the first light source are reflected by the first reflective cover so as to form a plurality of second reflected light beams, and a plurality of third light beams generated by the first light source are reflected by the first reflective cover so as to form a plurality of third reflected light beams; wherein, when the movable shielding assembly is moved from a first position to a second position by controlling of the movable driving component, the first reflected light beams pass through the optical lens so as to be converted into a plurality of first projected light beams, the second reflected light beams pass through the optical lens so as to be converted into a plurality of second projected light beams, and the third reflected light beams are blocked by the movable shielding assembly and do not directly pass through the optical lens; wherein, when the movable shielding assembly is moved from the second position to the first position, the first reflected light beams pass through the optical lens so as to be converted into the first projected light beams, the second reflected light beams are blocked by the movable shielding assembly and do not directly pass through the optical lens, and the third reflected light beams are reflected by the movable shielding assembly and pass through the optical lens so as to be converted into a plurality of third projected light beams.

8. The controllable vehicle lamp assembly according to claim 7, wherein the movable shielding assembly includes a pivot element disposed on the carrier module, a movable shielding element pivotably disposed on the pivot element, and an elastic element disposed around the pivot element, and the pivot element includes a first pivot portion and a second pivot portion that matches with the first pivot portion; wherein the elastic element has an elastic body disposed around the pivot element, a first abutting portion connected to a side of the elastic body for abutting against the carrier module, and a second abutting portion connected to another side of the elastic body for abutting against the movable shielding element, and the movable shielding element is moved from the second position to the first position by an elastic force provided by the elastic element; wherein the movable shielding element has a fixed matching portion, a stop portion for blocking the second abutting portion of the elastic element, and a penetrating portion corresponding to the fixed matching portion, the movable driving component includes a movable matching portion that matches with the fixed matching portion, and the movable shielding element is downwardly pulled by the movable driving component that is controlled by cooperation of the fixed matching portion and the movable matching portion, so that the movable shielding element is moved from the first position to the second position; wherein the optical module includes a light-reflecting component disposed under the optical lens, the light-reflecting component is disposed between the optical lens and a second reflective cover, and the optical lens protrudes further from the optical module than the light-reflecting component.

9. The controllable vehicle lamp assembly according to claim 8, wherein the movable shielding element has a first reflective surface and a second reflective surface obliquely connected to the first reflective surface, and the first reflective cover includes a first reflective body, a second reflective body connected to the first reflective body, and a shielding portion extending upwardly from the second reflective body; wherein the first reflective body has a first reflective curved surface, the second reflective body has a second reflective curved surface connected to the first reflective curved surface, and the first reflective curved surface has a curvature different from that of the second reflective curved surface; wherein the first light beams of the first light source are reflected by the first reflective curved surface of the first reflective cover so as to form the first reflected light beams, the second light beams of the first light source are reflected by the first reflective curved surface of the first reflective cover so as to form the second reflected light beams, and the third light beams of the first light source are reflected by the second reflective curved surface of the first reflective cover so as to form the third reflected light beams; wherein, when the movable shielding assembly is moved from the first position to the second position, the third reflected light beams are projected onto the second reflective surface of the movable shielding assembly and do not directly pass through the optical lens; wherein, when the movable shielding assembly is moved from the second position to the first position, the third reflected light beams are projected onto the second reflective surface of the movable shielding assembly and pass through the optical lens so as to be converted into the third projected light beams.

* * * * *